United States Patent [19]

Shaffer

[11] 4,231,614

[45] Nov. 4, 1980

[54] WHEELCHAIR

[76] Inventor: Gene P. Shaffer, 5139 Hazeltine, Sherman Oaks, Calif. 91423

[21] Appl. No.: 955,391

[22] Filed: Oct. 27, 1978

[51] Int. Cl.[2] ..... A47C 1/02

[52] U.S. Cl. ..... 297/330; 297/320; 297/DIG. 4; 297/DIG. 10

[58] Field of Search ..... 247/75, 76, 90, 91, 247/320, 321, 330, 345, 347, 348, DIG. 4, DIG. 10

[56] References Cited

U.S. PATENT DOCUMENTS

| | | | |
|---|---|---|---|
| 3,640,566 | 2/1972 | Hodge | 297/DIG. 10 X |
| 3,807,795 | 4/1974 | Weant | 297/DIG. 10 X |
| 3,964,786 | 6/1976 | Mashuda | 297/DIG. 10 X |
| 4,076,304 | 2/1978 | Deucher | 297/DIG. 10 X |

*Primary Examiner*—James C. Mitchell

*Attorney, Agent, or Firm*—Romney, Schaap, Golant, Disner & Ashen

[57] ABSTRACT

An improved wheelchair for mechanically assisting in moving a disable person between a sitting and a standing position. A method and apparatus for automatically coordinating the movements of the feet, lower-leg, thigh, seat and back, including the initial pivotal raising of the lower-leg and foot followed by a reversal of direction as the upper-leg and back commence pivotal movement to achieve preliminary alignment of the leg prior to achieving complete upright alignment of the entire body. A lever mechanism having a forward lever arm coupled to a lower-leg support through a cam, and a rearward lever arm coupled to a seat and/or back through a delayed-action channel member.

17 Claims, 9 Drawing Figures

WHEELCHAIR

This invention relates to a method and apparatus for moving and assisting a disabled person in going between a sitting and a standing position without the assistance of others, and more specifically to a so-called stand-up wheelchair which automatically coordinates the movements of the legs, seat and torso in order to obtain anxiety-free vertical alignment of the body.

There are many mechanical contrivances which manipulate the body of a disabled person between a sitting and standing position, but none have been developed which provide a single actuating member such as a lever assembly which satisfactorily coordinates the movement of the various parts of the body to achieve a standing position without incurring the risk of severe physical and/or emotional strain on the part of the disabled person.

The following United States patents are typical of the conventional structures of unsatisfactory operation:

U.S. Pat. No. 2,442,303; Mayfield
U.S. Pat. No. 3,261,031; Gates
U.S. Pat. No. 3,406,772; Ahrent et al
U.S. Pat. No. 3,787,089; Wrethander
U.S. Pat. No. 3,851,917; Horstmann et al
U.S. Pat. No. 3,964,786; Mashuda Accordingly, it is an important object of the present invention to provide an improved wheelchair construction which automatically coordinates the entire body through a sequence of steps to achieve a standing position, notwithstanding the inability of the user to exercise muscular control in keeping the joints of the lower body and extremeties in linear alignment.

It is a primary object of this invention to provide a fully powered and mechanized wheelchair which is capable of enabling a disabled person in a sitting position to be automatically brought to a standing position and/or to be returned to a sitting position.

It is a further object of the invention to provide a fully coordinated wheelchair in which seat, back and legrest movements are so linked and interrelated, without control of the user except for initial activation of the power system, that the user will automatically reach the desired standing or sitting position.

It is yet another object of this invention to provide a coordinated wheelchair in which legrest movements are initiated before seat and back movements so that the user's legs are straightened before his whole body becomes erect, the sequence of movements in going from a sitting to a standing position being designed to enhance confidence as the user approaches the vertically aligned body position with minimal or no muscular control needed to avoid the anticipation or the act of losing balance.

A further object is to provide a relatively simple, reliable and low cost mechanized wheelchair for enabling a disabled person to achieve conventional mobility in the sitting position while enabling such person to use the same wheelchair to easily help himself be raised from a sitting to a standing position without the aid of other persons.

A more specific object is to provide an improved wheelchair having a lever system which simultaneously raises and lowers the lower-leg during the period while the seat and back are raised and moved forwardly to achieve substantial linear alignment of the body as it approaches the upright position. A related object is to provide a substantial delay in movement of the torso and thighs while the lower leg is pivotally raised during an initial time period, and then to provide accelerated movement of the torso and thighs into upright position simultaneous with the change of direction and lowering of the lower leg back to an upright position.

Another specific object of the invention is to provide a channel member on the back and/or seat of the wheelchair for engaging one lever arm to move the back and seat upwardly and forwardly into aligned upright position, and to provide a cam member on the legrest of the wheelchair for engaging another lever arm to initiate upwardly and then downwardly a pivotal movement of the legrest to achieve a straightened leg substantially before the body reaches an upright position.

Additional objects, purposes and advantages of the invention will be evident to those skilled in the art in view of the preferred embodiment of the invention illustrated in the accompanying drawings and described in more detail hereinafter.

BRIEF DESCRIPTION OF THE DRAWINGS

FIG. 8 is a fragmentary sectional view taken along line 8—8 of FIG. 3.

Figure 1:
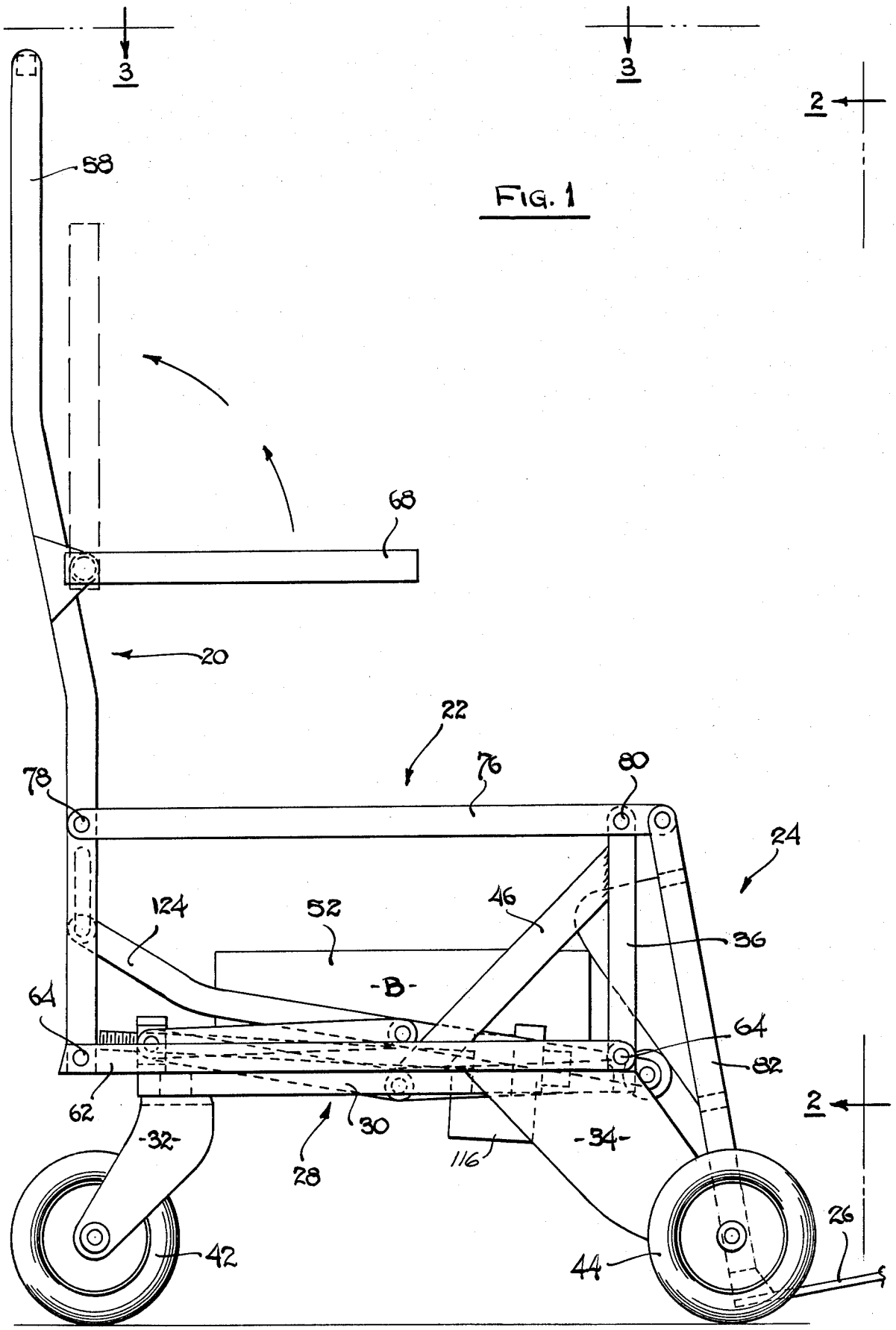
FIG. 1 is a side view of a presently preferred embodiment of the invention with the apparatus in conventional sitting position.
Figure 2:
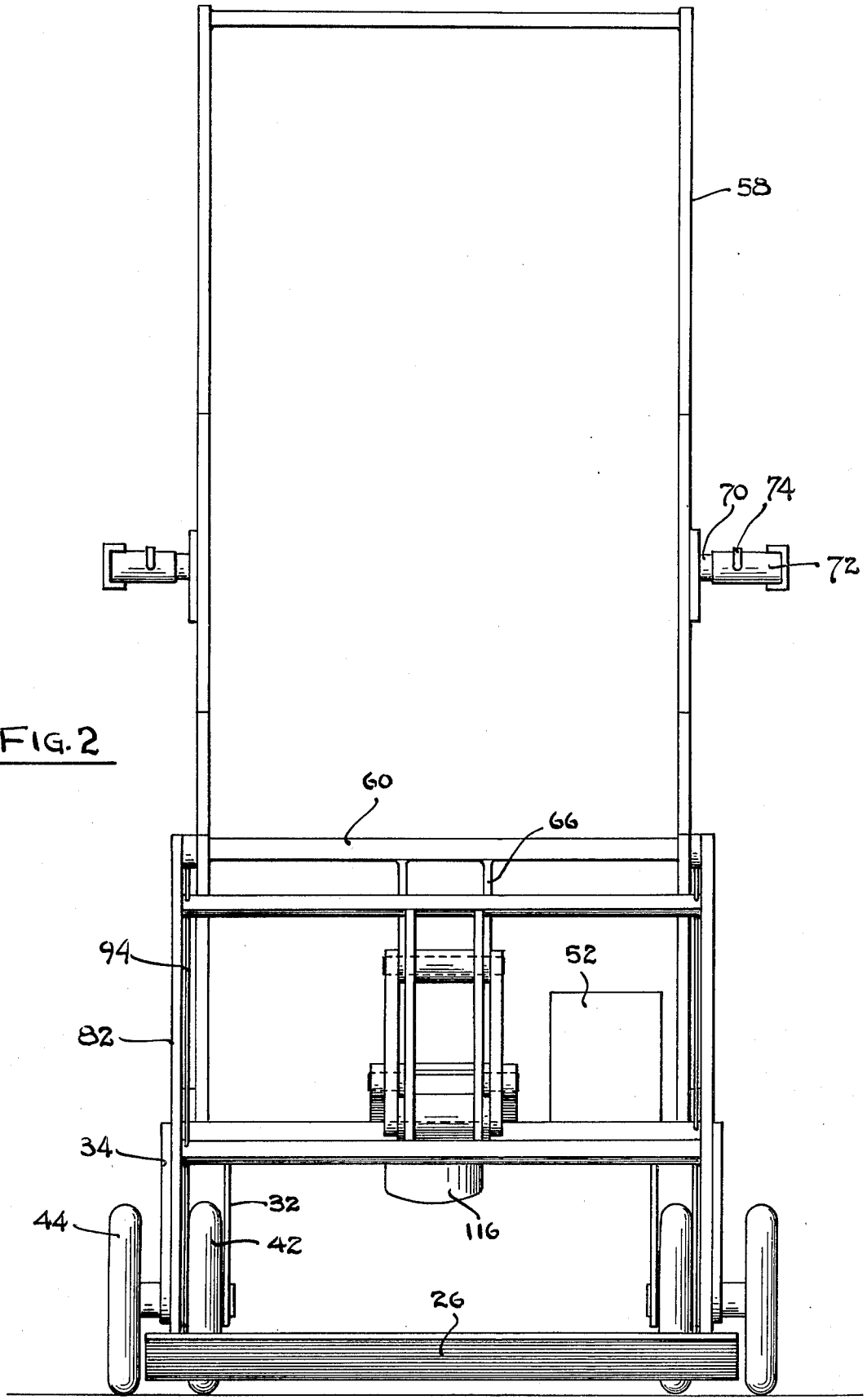
FIG. 2 is a front elevational view of the apparatus of FIG. 1.
Figure 3:
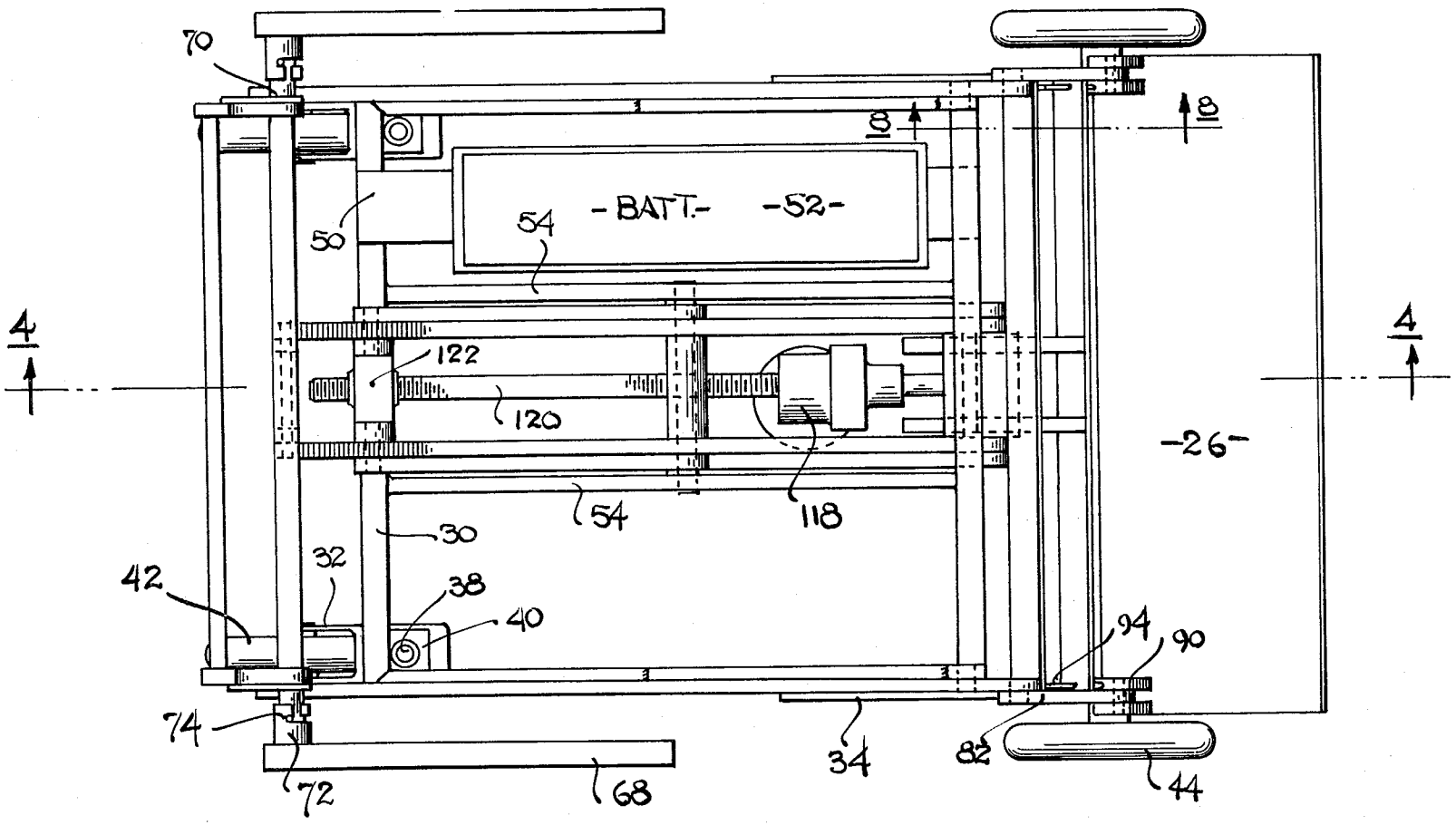
FIG. 3 is a top plan view of the apparatus of FIG. 1.
Figure 3:
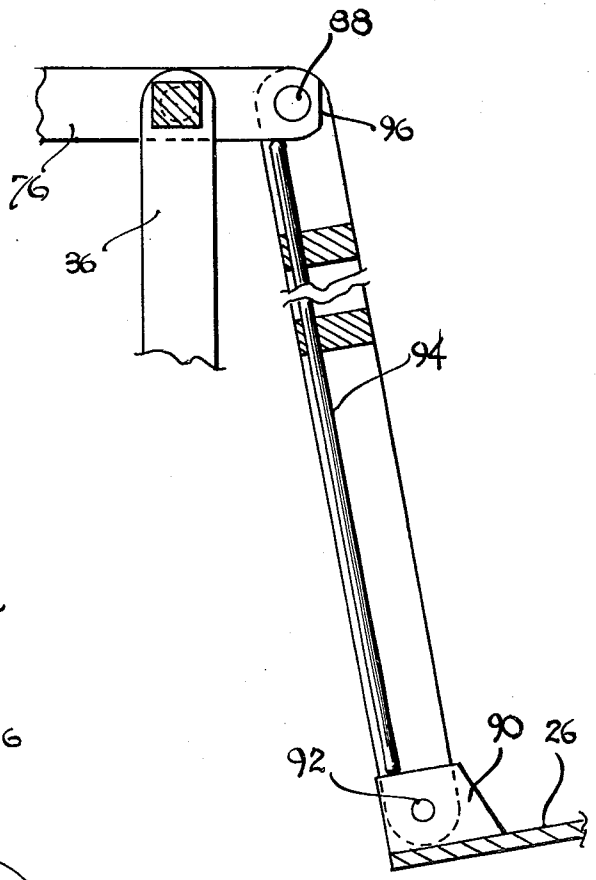

Generally speaking, the invention provides for coordinated repositioning of various wheelchair components, and particularly a back 20, a seat 22, and a lower-leg support 24 and its footrest 26, all of which move relative to each other and relative to a base 28 to enable a disabled person to be raised to a standing position and lowered down to a sitting position without assistance and in a manner which minimizes the usual anxieties experienced by using conventional stand-up wheelchairs.

The method developed as a result of extensive experimentation provides for an initial partial straightening of the legs at the knee joint while at the same time maintaining the thigh, seat and back substantially in sitting position. This is achieved by pivotally raising the lower-leg and foot forwardly up off the ground and delaying its return during an intermediate period during which the back and seat (and thighs) commence forward pivotal movement in a rotational or rotary direction opposite to the initial lower-leg and foot rotation. By reversing the original pivotal movement of the lower-leg and foot, but at a rate which is slower than the continuing pivotal movement of the back and seat, the legs are substantially straightened an appreciable amount of time before they become upright. Additionally, the feet are preferably kept bent or tilted slightly backward at the ankle joint until virtual upright stability is achieved at which time they are allowed to assume their normal position flat on the floor or ground.

The base in the illustrated embodiment is formed from a rectangular body 30, rear wheel brackets 32, front wheel brackets 34 and a vertical framework 36. The rear wheel brackets each have a shaft 38 journaled on a bearing plate 40 carried on the body to enable rear wheels 42 to change direction in response to manual or mechanized steering of the wheelchair. The front wheel brackets are fixedly attached to the body as by welding and are flared outwardly to mount front wheels 44 outside the brackets and beyond the side edge of the wheelchair to allow free movement of the lower-leg support and footrest in the space between the front wheels. The front wheel brackets also extend forwardly for stability to position the front wheels beyond the front edge of the body to be adjacent the footrest in its standing position. The vertical framework is fixedly mounted on the front of the rectangular body, with diagonal braces 46 providing additional structural support between the body and the framework. Extending across the interior of the rectangular body is a ledge 50 for supporting a battery 52, and a longitudinal pair of bars 54 for pivotally mounting a modified scissors lift 56.

The back is formed by an upright framework 58, a lateral bar 60 and a pair of auxiliary bars 62. Each auxiliary bar is connected between the lower ends of the vertical framework 36 and upright framework 58 by pivot pins 64 so that the auxiliary bars rest along the top of the rectangular body when the wheelchair is in sitting position. The lateral bar is affixed as by welding in an intermediate position across the upright framework and carries a pair of downwardly extending channels 66.

Armrests 68 are mounted on flanged shafts 70 appropriately located on the upright framework and include slotted sleeves 72 for receiving a stop pin 74 on the shaft to enable the armrests to be manually rotated between an extended and retracted position. Seat bars 76 are connected between the top of the vertical framework 36 and an intermediate point on the upright framework 58 as at the lateral bar 60 by pivot pins 78, 80, preferable so that each seat bar extends forwardly beyond the base and the pivot pin 80 connecting the base and the seat.

The lower-leg support includes a lattice-like frame 82 and a rearwardly facing cam 84 mounted thereon as by bolts 86. The frame is hingedly connected to the seat bars through a pivotal axis 88 located in front of pivot pin 80. The footrest 26 has bearing plates 90 for journaling axle 92 which extends through the lower end of the frame. The top surface of the bearing plates is engaged by a follower rod 94 which serves as a coupling between the footrest and a truncated hub or drum 96 mounted on the pivotal axis 88 for rotation with and as part of the seat bars.

The modified scissors lift 56 incorporates two pairs of lever arms 100, 102 directly mounted on the base through pivotal axle 104 and connected respectively through front and rear pivots 106, 108 to another two pairs of lever arms 110, 112 connected together through top pivot 113. A jackscrew power transfer assembly is mounted at 114 on lever arm 110 and includes an electric motor 116, a gear reduction unit 118, and jackscrew 120 extending through a threaded sleeve 122 attached at rear pivot 108. A rearward extension 124 of lever arms 110 carries a liftbar 125 which engages channels 66. A cam follower 126 mounted on front pivot 106 engages a first surface 128, an arcuate junction 130 and a second surface 132 of the cam 84.

Figure 4:
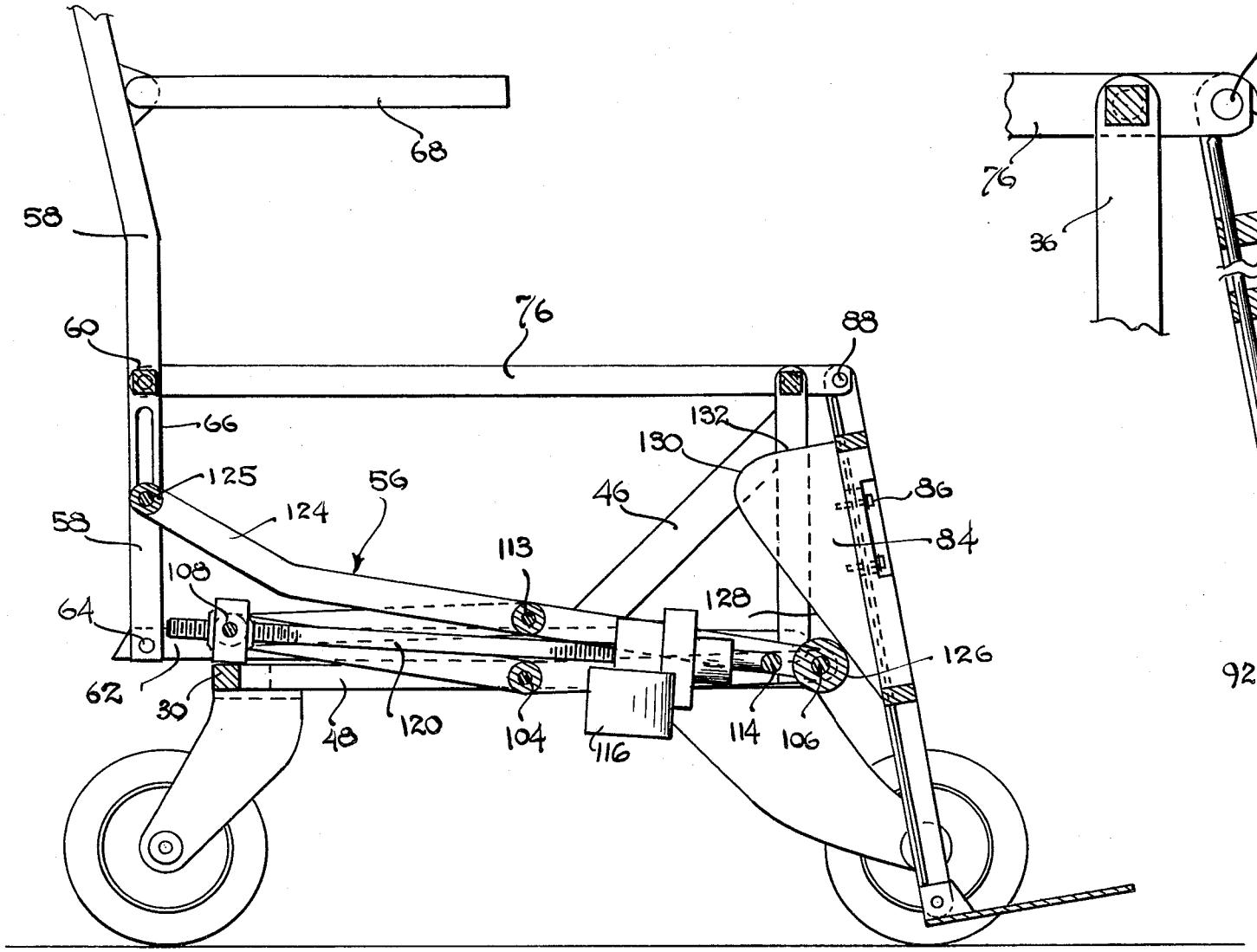
FIG. 4 is a sectional view taken along the line 4—4 of FIG. 3.
Figure 5:
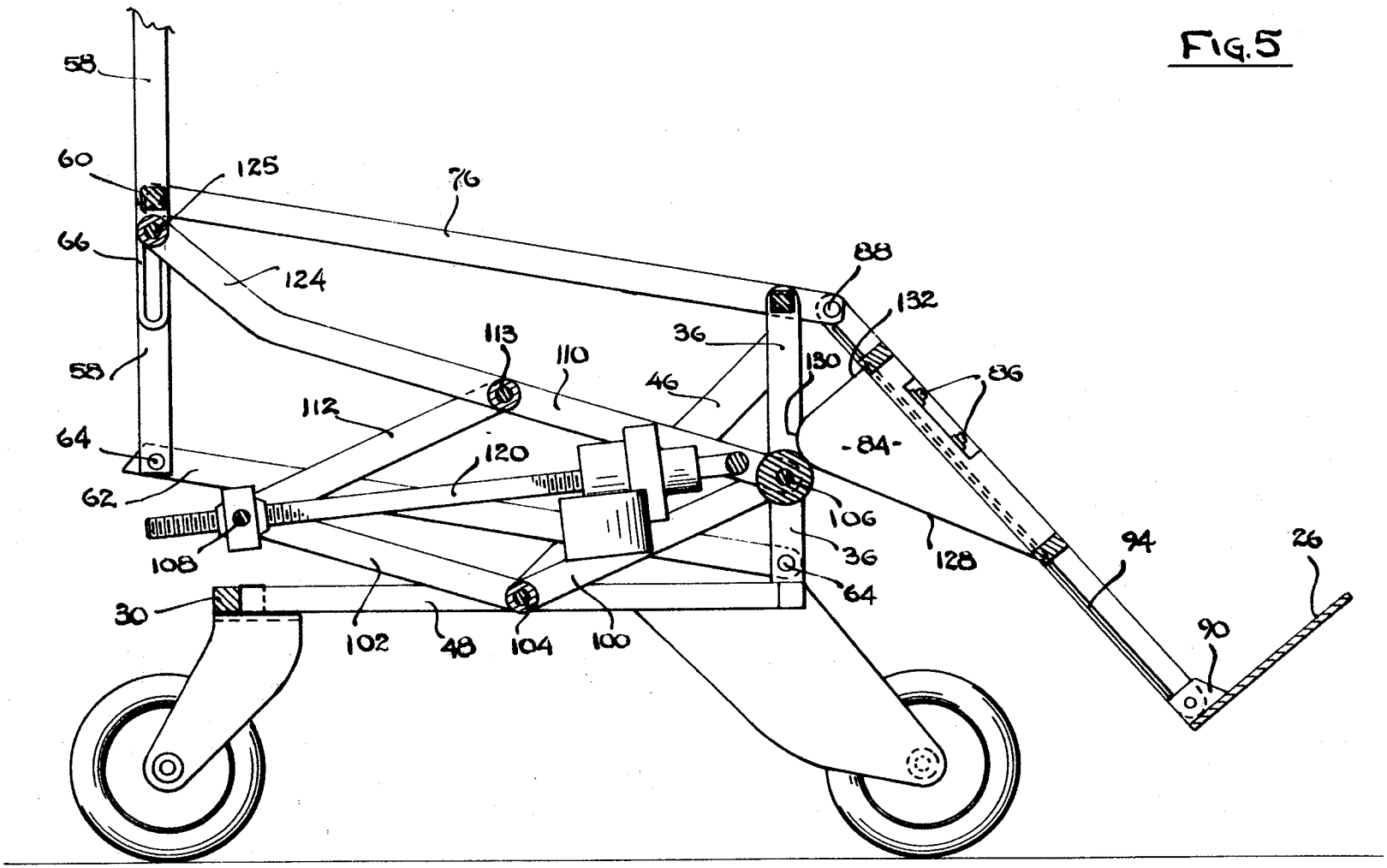
FIG. 5 is a sectional view like FIG. 4 with the lower-leg support in raised position.
Figure 6:
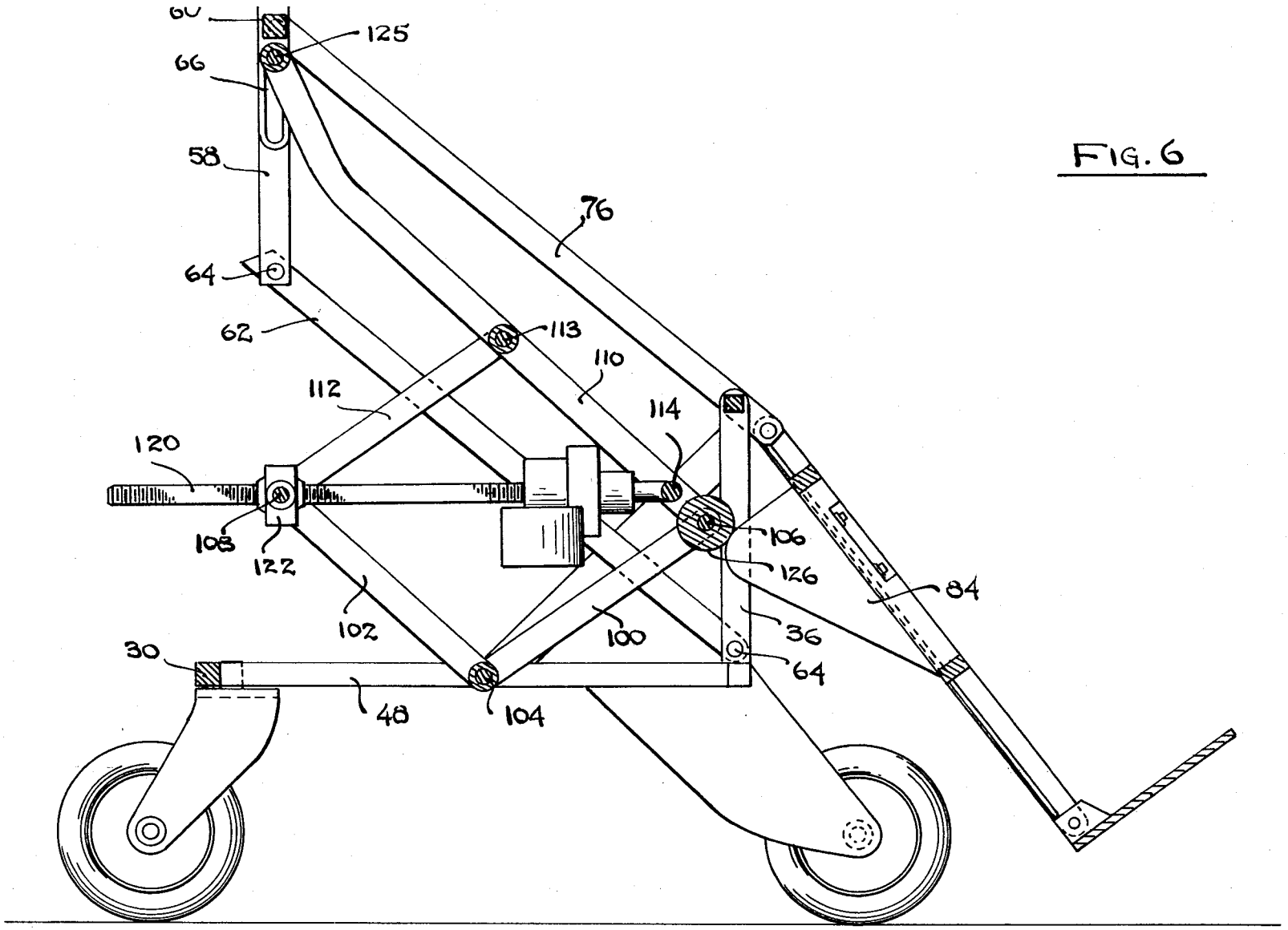
FIG. 6 is a sectional view like FIG. 4 with the lower-leg support in raised position and the seat and back in partially raised position.
Figures 7, 9:
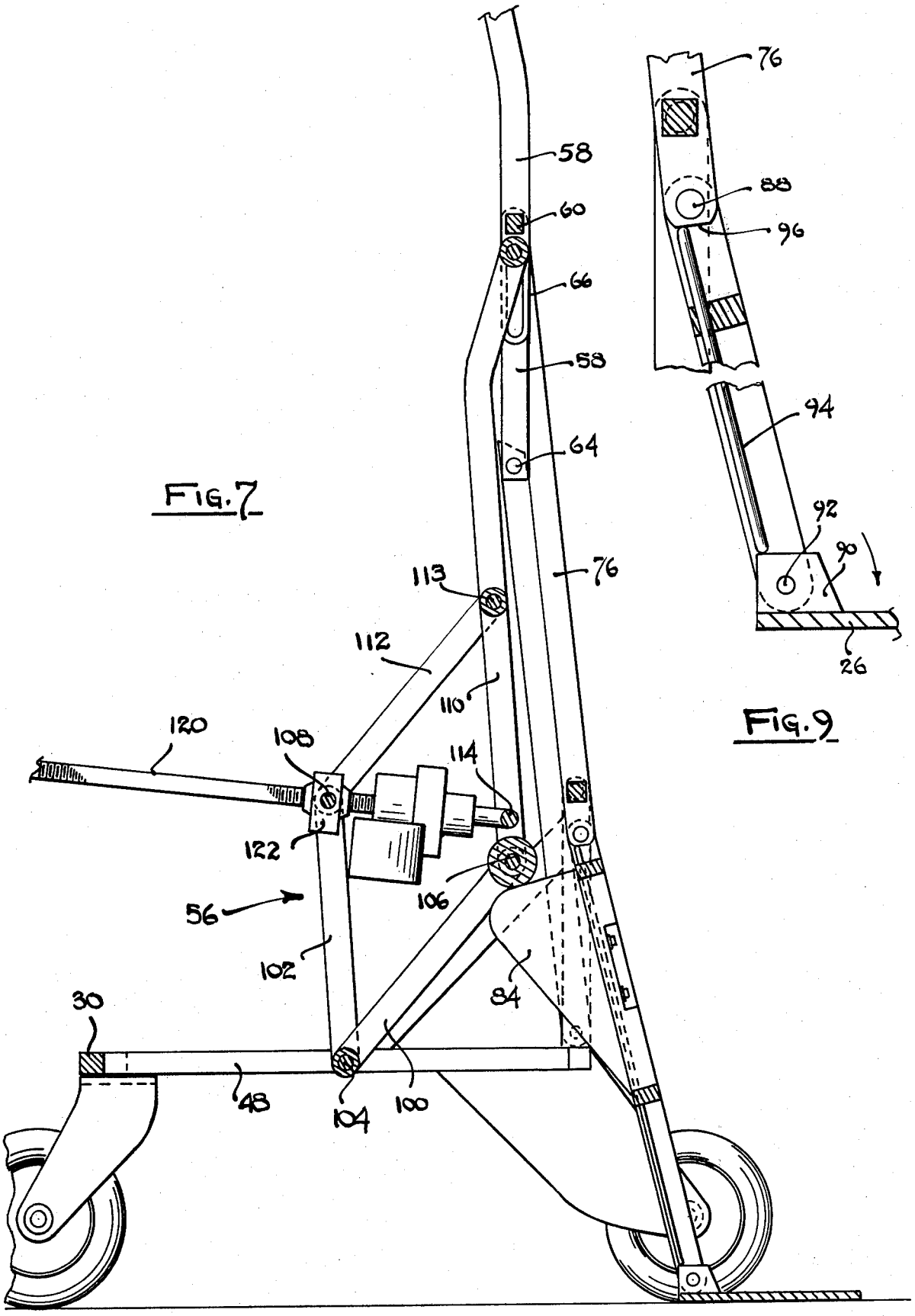
FIG. 7 is a sectional view like FIG. 4 with the apparatus in standing position.
FIG. 9 is a fragmentary sectional view like FIG. 8 with the footrest in lowered position.

It will be appreciated by those skilled in the art that the foregoing structure provides a unique coordinated movement of the various components of the wheelchair supporting a disabled person to go from a contentional sitting position to a standing position (See FIGS. 4–7) as well as from a standing position to a sitting position.

In this regard, activation of the electric motor causes rotation of the jackscrew in a first direction to draw the front and rear pivots of the scissors-type lever mechanism together while at the same time raising the top pivot upward away from the pivotal axle mounted on the base. During this initial period, the liftbar rides along the channels thus delaying any upward lifting of the seat and back until the liftbar hits the stop at the end of the channels. During this delay period, the cam follower rides along the first inclined cam surface causing the lower-leg rest or support to move pivotally up away from the base. As the cam follower rides around the arcuate junction surface of the cam to reverse the directional movement of the lower-leg support, the liftbar begins to move the pivot pin connecting the back and seat upwardly and forwardly to continually increase the angle between the back and the seat (See FIGS. 5–6). As the cam follower rides along the second cam surface in a direction different from the first cam surface, the lower-leg support reverses direction and moves pivotally toward the base as the back, seat and lower-leg support achieve increasingly greater alignment as they approach the upright position. In the exemplary embodiment, the back and seat rotate faster than the lower-leg rest thus enabling the knee joints of the disabled person to become straightened before the person loses the underlying support of the seat and lower-leg rest. The feeling of stability is also assured by achieving a center of rotational motion in the knee area and in the lower thigh area rather than merely providing lopsided tilting only from the knees up. This feeling of stability is further enhanced by keeping the footrest tilted backward until the last moment when it finally pivots forwardly to rest flat against the floor. This latter motion is achieved by the camming action of the truncated drum on the rod which serves to pivot the footrest relative to the lower-leg support frame. The arm rests provide supplemental support as the person approaches the standing position and can be easily retracted out of the way when no longer needed.

Thus the user of the wheelchair of the present invention can activate a single control switch after which all further movements (except for the retraction of the armrests) are performed in a sequential interrelated manner automatically. Moreover, the mechanical assistance in straightening the legs initially before the weight of the torso is substantially carried by the legs provides added confidence to the user which was not possible with many prior art devices. Also, reversing the steps achieves the sitting position. Although an exemplary embodiment of the invention has been disclosed for illustrative purposes, it will be understood that various changes, modifications and substitutions may be incorporated in such embodiment without departing from the invention as defined by the claims hereinafter.

I claim:

1. An improved wheelchair for mechanically assisting in moving a disabled person between a sitting and a standing position, said wheelchair comprising:

a base;

a seat located above said base and hingedly connected to said base through a first pivotal axis means, said first pivotal axis means for allowing rotation of said seat in an arc relative to said base;

a back located behind said seat and hingedly connected to said seat through a second pivotal axis means which is separated from and movable relative to said base, said second pivotal axis means for allowing said back to move both upwardly, downwardly and laterally relative to the front end of said seat and upwardly, downwardly and laterally relative to said base;

lever means located below said seat, pivotally mounted on said base and connected to said back, said lever means for causing said upward, downward and lateral movements of said back relative to the front end of said seat and to said base, and for causing said rotation of said seat relative to said base;

a lower-leg rest hingedly attached to the front end of said seat through said first pivotal axis means, said first pivotal axis means for allowing pivotal upward and downward movements of said lower-leg rest relative to said seat and said base;

cam means coupled between said lever means and said lower-leg rest for causing said lower-leg rest to move pivotally relative to said seat; and power means on said wheelchair and in operative connection with said lever means, said power means for actuating said lever means.

2. The device of claim 1 wherein said first pivotal axis means includes a rearward pivotal axis attached to said base and which connects said seat to said base, and a forward pivotal axis separated from and movable relative to said base and which connects said seat to said lower-leg rest, and wherein said lower-leg rest further includes a frame and a footrest pivotally connected to the lower end of said frame.

3. The device of claim 2 wherein said frame includes control means coupled to said footrest for allowing said footrest to lay flatly against the floor when said frame, said seat and said back are in an upright position and for tilting said footrest backward toward said frame when said frame, said seat and said back are not in an upright position.

4. The device of claim 3 wherein said control means includes rod means engageable by said forward pivotal axis for tilting said footrest forwardly when said seat and said frame are substantially aligned in upright position.

5. The device of claim 1 wherein said cam means includes a cam mounted on said lower-leg rest and a cam follower connected to a forward end of said lever means and engaging said cam to cause both upward and downward pivotal movements of said lower-leg rest relative to said base.

6. The device of claim 5 wherein said cam includes a first face which is engaged by said cam follower during said upward movement of said lower-leg rest and a second face which is engaged by said cam follower during said downward movement of said lower-leg rest.

7. The device of claim 1 wherein said base includes a laterally extending bottom member on which said lever means is pivotally mounted and an upright front member to which said seat is hingedly connected.

8. The device of claim 1 wherein said back further includes two armrests manually moveable between an extended position and a retracted position to facilitate both the support and movement of the disabled person.

9. The device of claim 1 wherein said back includes channel means pivotally and slidably engaging said lever means for delaying the initial movement of said back until after the pivotal upward movement of said lower-leg rest, said delay being due to the time required for said lever means to move along said channel means prior to applying upward force on said back.

10. The device of claim 1 wherein said lever means includes opposing and interconnected lever arms with a forward arm coupled to said cam means and a rearward arm connected to said back, and screw means coupled to at least one of said lever arms for simultaneously moving said forward and rearward lever arms upwardly toward each other when moving a disabled person to a standing position, and downwardly away from each other when moving a disabled person to a sitting position.

11. An improved wheelchair for mechanically assisting in moving a disabled person between a sitting and a standing position, said wheelchair comprising:

a base;

a seat located above and hingedly connected at its forward end to said base through pivotal axis means for allowing pivotal movement of said seat relative to said base;

a back located behind and hingedly connected to a rear end of said seat through a first pivotal axis which is movable relative to said base;

a lower-leg support hingedly connected to a forward end of said seat through said pivotal axis means for allowing pivotal movement of said lower-leg support relative to said seat and said base;

lever means pivotally mounted on said base and located below said seat for movement in one direction to raise the disabled person to a standing position;

power means including a control switch on said wheel chair and in operative connection with said lever means for moving said lever means in said one direction;

cam means coupled between said lever means and said lower-leg support for causing said lower-leg support to be upwardly rotated away from said base during one time period and to be downwardly rotated toward said base during a subsequent time period while said lever means moves in said one direction; and said back including attachment means connected to said lever means for moving said back upwardly and forwardly relative to said base and for moving said first pivotal axis and said seat upwardly and forwardly to continually increase the angle between said back and said seat while at the same time rotating said seat relative to said base to ultimately reposition said back and said seat in forward upright positions substantially aligned with each other and substantially aligned with said lower-leg support after termination of said subsequent time period.

12. The device of claim 11 wherein said attachment means includes delay means for delaying the collective movement of said back, said seat, and said first pivotal axis during said one time period while said cam means causes said lower-leg rest to be upwardly rotated during said one time period.

13. The device of claim 12 wherein said delay means includes a channel with a stop at one end, said channel engaged by said lever means to allow movement of said lever means along said channel until said lever means hits said stop.

14. The device of claim 11 wherein said lever means includes scissor means having a forward arm engaging said cam means and a rearward arm linked to said attachment means of said back.

15. The device of claim 14 wherein said scissor means is mounted through a second pivotal axis to said base, and further including a power transfer member coupled between said power means and said scissor means to actuate said scissor means about said second pivotal axis and raise said forward and rearward arms in said one direction.

16. The device of claim 14 wherein said cam means includes a first cam surface engaged by said forward arm during said one time period and a second cam surface engaged by said forward arm during said subsequent time period, said second cam surface being disposed in a direction different from said first cam surface.

17. A method of actuating wheelchair components for moving a disabled person from a sitting position in a wheelchair to a fully erect standing position without the assistance of others, comprising the steps of:

initiating pivotal movement of the lower-leg to begin raising the lower-leg and foot upwardly;

maintaining the thighs and back in a generally sitting position during said initiating step;

decelerating and stopping the upward pivotal movement of the lower-leg and foot while simultaneously commencing the upward and forward pivotal movement of the back, thighs and seat in an opposite rotary direction;

reversing the original direction of pivotal movement of the lower-leg and foot in order to cause their rotation in the same rotary direction as, but at a lesser rate than, the continuing upward and forward pivotal movement of the thighs, seat and back;

straightening the legs into substantial linear alignment before the legs reach an upright position; and terminating rotation of the body when the torso and legs reach a substantially upright aligned position.

* * * * *